United States Patent [19]

Moore

[11] 4,294,446

[45] Oct. 13, 1981

[54] FRICTION TYPE EXERCISING DEVICE WITH IMPROVED FRICTION SETTING INDICATOR

[75] Inventor: Gerald L. Moore, San Jose, Calif.

[73] Assignee: Ronald E. Useldinger, San Jose, Calif.

[21] Appl. No.: 59,899

[22] Filed: Jul. 23, 1979

[51] Int. Cl.[3] ..... A63B 21/00

[52] U.S. Cl. ..... 272/133; 116/282; 188/65.4; 242/100.1; 272/DIG. 5

[58] Field of Search ..... 272/133, 125, 131, 142, 272/143, DIG. 3, DIG. 4, DIG. 5, DIG. 6; 188/65.1, 65.2, 65.3, 65.4, 65.5; 242/100.1; 73/379; 116/31, 224, 225, 261, 262, 281, 282, 309, 321, 323, DIG. 1; 182/5, 6, 7

[56] References Cited

U.S. PATENT DOCUMENTS

| | | | |
|---|---|---|---|
| 183,144 | 10/1876 | Cruickshank | 116/282 X |
| 3,197,204 | 7/1965 | Holkesvick et al. | 272/133 |
| 3,229,659 | 1/1966 | Sciascia | 116/282 |
| 3,591,174 | 7/1971 | Silberman et al. | 272/133 |
| 3,782,722 | 1/1974 | Webb | 272/133 |
| 3,885,789 | 5/1975 | Deluty et al. | 272/133 |
| 4,040,627 | 8/1977 | Useldinger | 272/133 |
| 4,155,547 | 5/1979 | Savio et al. | 272/DIG. 5 |
| 4,174,832 | 11/1979 | Thompson | 272/133 |

FOREIGN PATENT DOCUMENTS

| | | | |
|---|---|---|---|
| 1108199 | 4/1968 | United Kingdom | 272/133 |

*Primary Examiner*—Richard C. Pinkham
*Assistant Examiner*—Arnold W. Kramer
*Attorney, Agent, or Firm*—Gerald L. Moore

[57] ABSTRACT

An exercise device which can be fixed to a support and through which a rope is pulled against the force of frictional engagement within the exercise device. The resistive force against the pull is determined by the number of turns of the rope about a center shaft in the exercise device. The force is indicated by an improved indicator which moves longitudinally in the device as the number of turns is changed and which can be viewed for determining the frictional force.

11 Claims, 5 Drawing Figures

FRICTION TYPE EXERCISING DEVICE WITH IMPROVED FRICTION SETTING INDICATOR

BACKGROUND OF THE INVENTION

This invention relates to exercise devices of the type utilizing a rope wrapped around a shaft to create a frictional force resisting pull on the rope. Such devices are shown in such patents as U.S. Pat. No. 4,040,627. In this device the rope is passed into a cavity in a housing which includes a center shaft. The rope is wrapped about the shaft and passed back out through the body member.

Exercise is accomplished by pulling on one end of the rope against the frictional force created thereon within the device. This frictional force is adjusted by rotating the shaft relative to the housing. The problem in the past has been in providing a visual indication of the resistive force exerted on the rope, which resistive force is proportional to the number of turns wound around the center shaft. The above-mentioned patent describes one method of providing such a visual indication. The purpose of the present invention is to provide an improved indicator for an exerciser of this type to show the approximate pull which must be exerted on the rope to move it through the exerciser.

SUMMARY OF THE INVENTION

An exercise device wherein a shaft is positioned within a hollow housing and a rope is passed into the body member, around the shaft and back out of the housing. The frictional engagement and therefore the force to pull the rope is determined by the number of turns the rope is wound around the shaft. To vary the turns, the shaft is turned relative to the housing. For indicating the turns a slide is positioned in the housing to move longitudinally as the shaft is turned and by viewing the position of this slide, the force needed to pull the rope is indicated.

DESCRIPTION OF THE INVENTION

Figure 2:
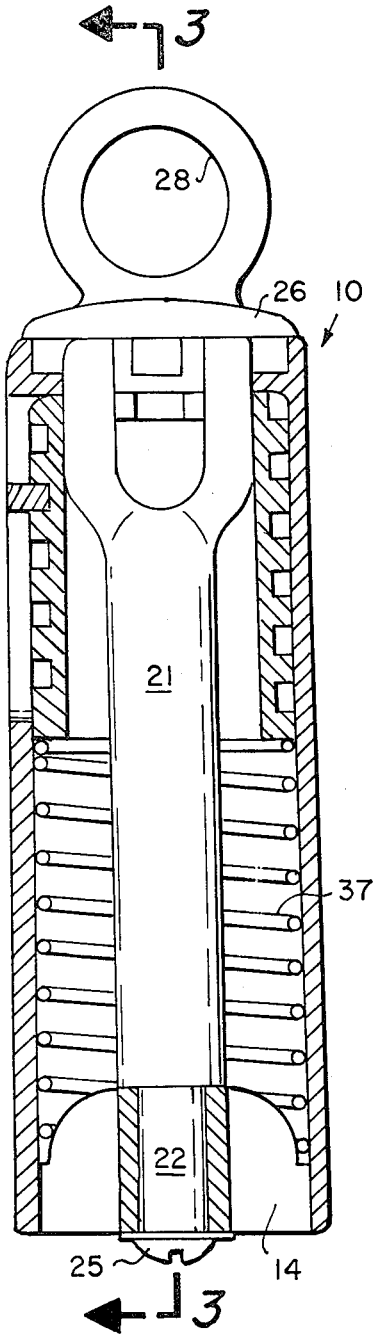
FIG. 2 is a cross-sectional view of the exerciser in assembled form.
Figure 3:
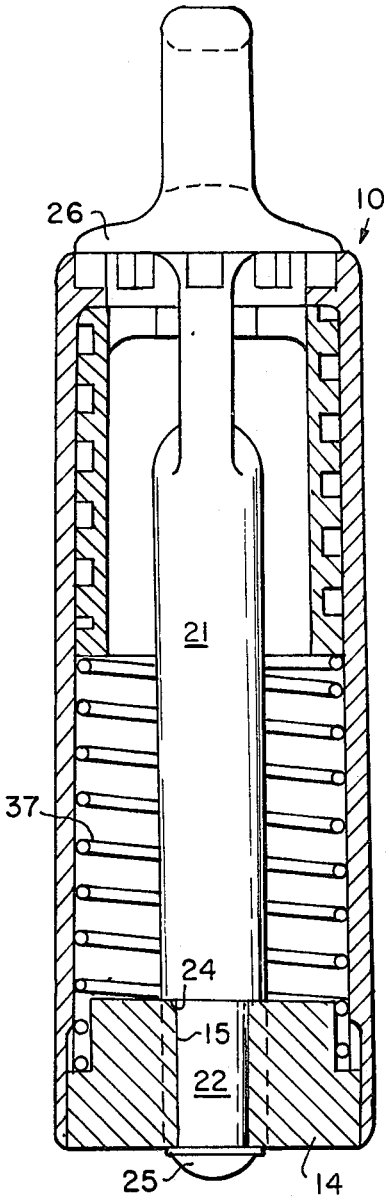
FIG. 3 is a cross-sectional view along the line 3—3 of FIG. 2.
Figure 5:
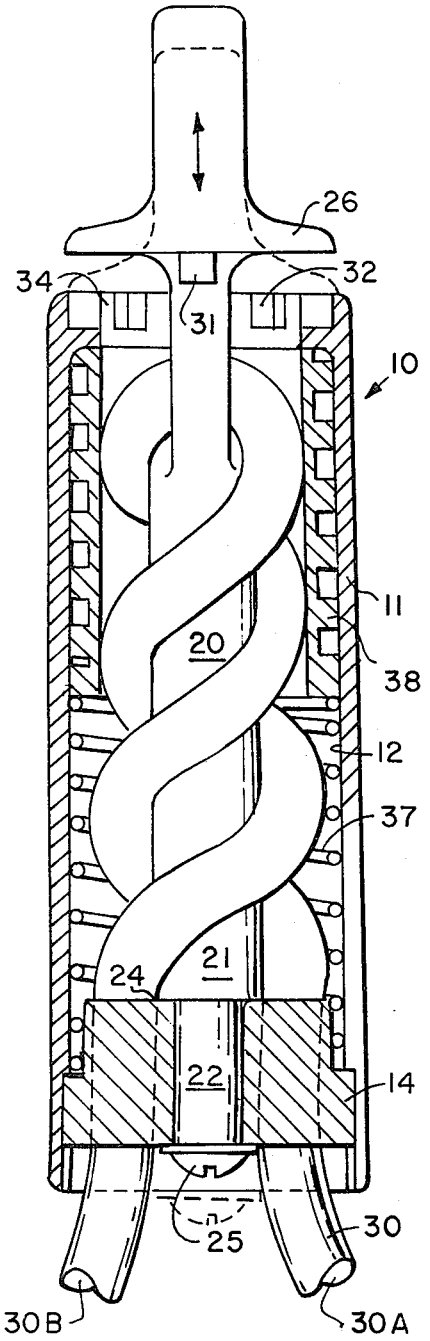
FIG. 5 is a cross-sectional view of the exerciser with the rope and showing the manner in which the shaft is shifted axially for varying the number of rope turns.
Figure 4:
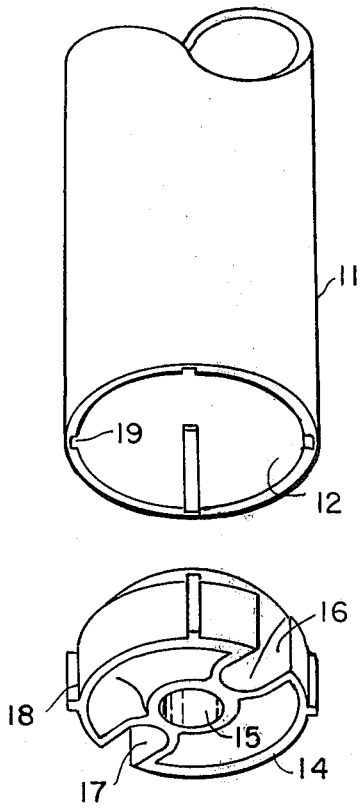
FIG. 4 is a partial view of the housing and hub.

As shown primarily in FIGS. 2, 3 and 5 the exerciser device 10 comprises a housing 11 enclosing a center cavity 12. Preferably the housing is cylindrical in configuration as is the cavity. A hub 14 is positioned to form one end wall of the cavity and includes a center opening 15 and first and second openings 16 and 17 on opposite sides of the center opening. The hub includes ridges 18 on the outer periphery thereof which align with slots 19 on the inner surface of the housing to prevent rotation relative to the housing. Preferably the hub and housing are formed of a molded plastic material.

A center shaft 20 coincides with and forms a central axis of the housing and includes a center portion 21 and a reduced diameter portion 22 separated by a shoulder

24. The small diameter end portion 22 fits through the opening 15 in the hub and is held there by a bolt 25 which is threaded into an opening (not shown) in the end of the hub. The center shaft includes a flange 26 separating openings 27 and 28 positioned at the end thereof opposite the reduced diameter end 22.

As shown primarily in FIG. 5 a rope-like member 30 is threaded through the first opening 16 of the hub and extended along the shaft to be passed through the rope opening 27 and returned along the shaft and out through the second opening 17 of the hub. By passing a rope or other fastening device (not shown) through the opening 28 on the shaft, the exercise device can be fixed to a door or other stationary object. Thereafter the prescribed exercises can be performed by pulling first on the end 30A of the rope and thereafter on the end 30B of the rope. Movement of the rope through the exercise device is resisted by a force resulting from the frictional engagement between the rope and the shaft 20. Naturally the more turns of the rope about the shaft the greater the frictional engagement. It has been found that such adjustment of the frictional force is predictable with knowledge of the number of rope turns about the shaft.

Figure 1:
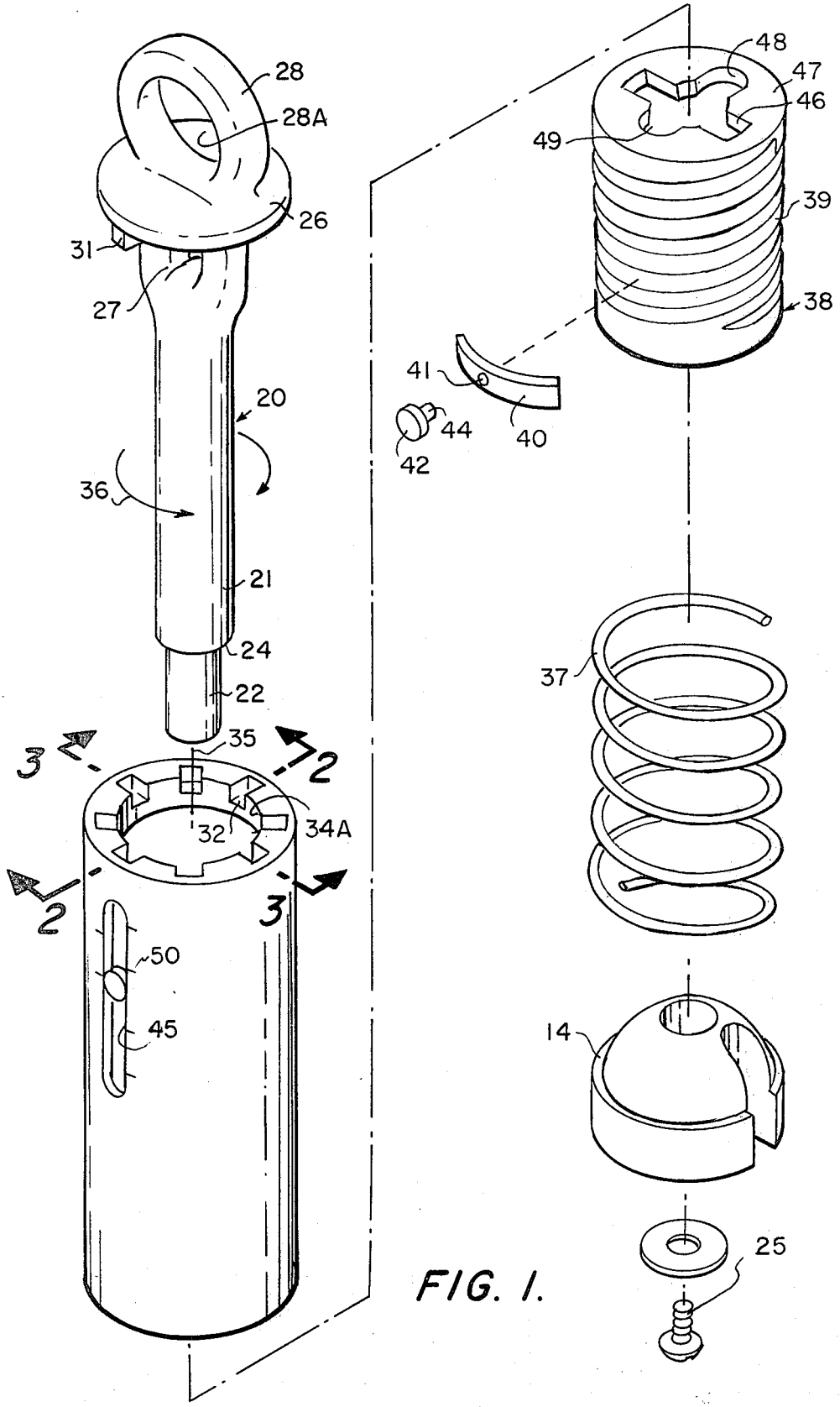
FIG. 1 is an exploded view of an exerciser incorporating the subject invention.

For adjustment of the rope turns about the shaft, the shaft is supported by means permitting rotation within the housing. For this purpose there is fixed to the underside of the flange 26 one or more lugs 31 sized to fit within recesses 32 in an end wall member 34 formed integral with and closing the second end of the housing 11. The center opening 34A in this end wall member is large enough to allow rotation of the shaft therein. Thus by pulling on the ring 28 and holding the housing 11, the shaft can be shifted along the longitudinal axis 35 (FIG. 1) a sufficient distance to lift the lugs 31 from the aligned recesses 32 of the ring. Thereafter by rotation of the shaft relative to the housing 11 and the hub 14 the number of turns of the rope about the shaft can be increased or decreased depending upon the rotation of the shaft in the direction indicated by the arrow 36. With the desired number of turns of the rope, the shaft 20 is then moved axially towards the housing to seat the lugs 31 in the aligning recesses 32 for holding the shaft against further rotation within the housing.

To hold the shaft in the locked position, i.e. stationary relative to the housing, there is positioned within the center cavity 12 of the housing a spring 37 extending between the hub 14 and a sleeve 38. The spring 37 biases the hub 14 in a direction to hold the lugs 31 in the recesses 32. Subsequent pulling on the rope ends 30A and 30B tends to seat these lugs in the recesses even tighter because of the frictional engagement between the rope and the hub 14.

To visually indicate to the user the number of turns on the rope there is provided a single screw thread 39 on the outer cylindrical surface of the sleeve 38. Conforming with and fitting within this screw thread is a slide 40 having a curved configuration. In a center opening 41 of the slide is an indicator pin 42 held by a small lug 44. The pin 42 fits through an opening 45 extending longitudinally along the housing in the direction of the longitudinal axis as shown primarily in FIG. 1.

The center shaft portion forming the rope opening 27 has a substantially rectangular cross-section sliding through a similar rectangular opening 46 in the end wall 47 of the sleeve 38. Side openings 48 and 49 are provided in the sleeve through which the rope can be passed as it extends towards and away from the rope opening 27 in the shaft. Thus the sleeve 38 allows axiall movement of the shaft as is necessary before rotation of the shaft is effected after the unseating of the lugs 31 from the recesses 32, but rotates within the housing as the shaft is rotated. Rotation of the shaft and sleeve causes the slide 40 to travel in the direction of the central axis of the housing since the slide is held against rotation within the housing 11 by the lug 42 extending through the opening 45. Thus as the number of rope turns are changed by rotation of the center shaft, the pin 42 moves along the slot 45 in the housing to indicate the approximate pull or resistive force that will be impressed as the rope is pulled. Markings 50 can be printed on the outside of the housing to show the force on the rope which can be expected by the user when the pin aligns therewith.

In the manner just described there is provided an improved indicating means for showing the resistive force imparted on the rope by each setting of the center shaft relative to the housing.

The invention claimed:

1. An exercise device, comprising in combination:

a housing having an outer wall forming a hollow cavity, said housing having a central axis;

a shaft positioned within the cavity and held to allow axial and rotative movement relative to said housing when moved in one axial direction and preventing axial rotative movement relative to said housing when moved in the other axial direction;

a hub positioned in said cavity and fixed to said shaft to move axially therewith while allowing rotation of the shaft relative to said hub, said hub being nonrotatable with respect to said housing;

first and second openings in said hub;

a rope-like member extending through said first opening in the hub, around said shaft and out the second opening in said hub whereby when the rope-like member is pulled frictional resistance is exerted on said rope-like member in proportion to the number of turns around said shaft;

means attaching said rope-like member to the shaft whereby with relative rotation of the shaft and the hub, the number of turns of the rope-like member about the shaft is changed;

releasable means for holding the shaft against rotation relative to said housing which when released allows rotation of said shaft within said cavity thereby to change the number of turns said rope-like member is wound around said shaft;

a slide positioned with said cavity;

means connecting said slide, shaft and housing to cause movement of said slide in the direction parallel of the central axis with relative rotation between said shaft and housing; and an opening in said housing in a position to allow viewing of the position of said slide thereby to indicate the number of turns said rope-like member is wound around said shaft.

2. An exercise device as defined in claim 1 wherein said housing includes a third opening connecting with said hollow cavity and said shaft includes an end portion extending therethrough.

3. An exercise device as defined in claim 2 including means for fastening said shaft to a stationary member to anchor said exercise device while the rope-like member is pulled.

4. An exercise device as defined in claim 3 wherein said means attaching the rope-like member to the shaft is an opening in the shaft through which the rope-like member is passed.

5. An exercise device as defined in claim 2 wherein said releasable means for holding the shaft comprises a housing end portion including recesses positioned adjacent said third opening and lugs fixed to said shaft and positioned to fit into said recesses.

6. An exercise device as defined in claim 5 wherein said shaft is movable lengthwise to shift said lugs from said recesses and allow rotation of said shaft.

7. An exercise device as defined in claim 6 including spring means positioned between the shaft, hub and housing to urge the shaft in a direction to force said lugs into said recesses.

8. An exercise device as defined in claim 7 wherein said means connecting said slide, shaft and housing comprises a sleeve fixed to rotate with said shaft and having a threaded surface into which said slide fits.

9. An exercise device as defined in claim 8 wherein said opening in said housing comprises a slot extending in the direction of the central axis, aligned with said sleeve and slide and through which the position of the slide can be viewed.

10. An exercise device as defined in claim 1 wherein said means connecting said slide, shaft and housing comprises a sleeve fixed to rotate with said shaft and having a threaded outer surface into which said slide fits for movement in the direction parallel of the housing central axis as the sleeve is rotated.

11. An exercise device as defined in claim 10 wherein said housing includes a slot extending in the direction of the central axis, aligned with said sleeve and slide and through which the position of the slide can be viewed.

* * * * *